United States Patent [19]

Hodack

[11] 4,378,926

[45] Apr. 5, 1983

[54] ARTICLE-HANGER AND ILLUSION-AMUSEMENT DEVICE

[76] Inventor: Robert J. Hodack, 2132 Holmes Ave., Springfield, Ill. 62704

[21] Appl. No.: 162,797

[22] Filed: Jun. 25, 1980

Related U.S. Application Data

[63] Continuation-in-part of Ser. No. 901,614, May 1, 1978, abandoned.

[51] Int. Cl.[3] ..... A47G 1/16

[52] U.S. Cl. ..... 248/489; 248/DIG. 8; 248/216.1; 411/377

[58] Field of Search ..... 248/216.1, 466, DIG. 8, 248/489; 52/27, 38; 411/377

[56] References Cited

U.S. PATENT DOCUMENTS

| | | | |
|---|---|---|---|
| 73,088 | 1/1868 | Gardner | 411/377 X |
| 439,830 | 11/1890 | Berbecker | 411/377 X |
| 1,413,833 | 4/1922 | David | 248/216.1 X |
| 1,797,220 | 3/1931 | Brock | 248/217.4 |
| 1,809,562 | 6/1931 | Nelson | 248/466 X |
| 2,224,772 | 12/1940 | Ross | 248/216.1 X |
| 2,583,129 | 1/1952 | Worth | 248/DIG. 8 |

*Primary Examiner*—William H. Schultz
*Attorney, Agent, or Firm*—Ralph F. Staubly

[57] ABSTRACT

For amusement, and for utility as an article hanger, a molded plastic body simulates the head end of a full-size railroad-rail-anchoring spike. The head end of a relatively small screw is embedded in the molded body to extend therefrom for perpendicular insertion into a wall or partition or door, to create the illusion that a large spike has been surface-defacingly driven into the wall. In the preferred embodiment of the invention, the screw extends perpendicularly from the beveledly truncated head-end portion of the spike to create the illusion that the spike has been driven angularly downwardly into a vertical structure. A smaller body, simulating the pointed end of a spike, is similarly constructed for aligned positioning on the opposite side of a partition or door to create the illusion that the spike has been driven downwardly-angled entirely through its supporting structure.

4 Claims, 5 Drawing Figures

ARTICLE-HANGER AND ILLUSION-AMUSEMENT DEVICE

This application is a continuation-in-part of now-being-abandoned application Ser. No. 901,614, filed May 1, 1978 and identically entitled.

BACKGROUND AND OBJECTS OF THE INVENTION

While large nails, screws and pegs have commonly been used as garment and picture hangers, none is known to be in the form of a simulated full-size railroad-rail-anchoring spike having a relatively small wall-penetrating and wall-protecting anchoring screw extending perpendicularly from the angularly truncated face of the spike to create the illusion that the spike has been surfacedefacingly driven downwardly into or through a wall, partition or door. It is accordingly the principal object of this invention to provide such a device.

BRIEF DESCRIPTION OF THE DRAWINGS

With reference now to FIGS. 1–3 of the drawings, the numeral 11 generally designates a simple embodiment of the invention, which comprises a molded (preferably plastic) body 13 including a head portion 15 and a screw 17. The body 13 and its head 17 simulate in size, shape and appearance the upper portion of a railroad-rail-anchoring spike. The head end of the screw 17 is embedded in the free end of the body 15 to protrude axially thereof for screwing into a wall panel 19 of wood, metal, dry-wall, etc. In FIGS. 1 and 2 there is shown in phantom a clothes bag 21 having a hanger loop engaged over the device 11.

FIG. 4 discloses a second species of the invention which comprises a body 23 having a head 25, a bolt 27 and a pointed spike-end-simulating member 29. Parts 23,25 and 29 are preferably formed of cast or molded plastic (but could be metallic if preferred). The bolt 27 has its head embedded in part 23 and its end received in an axial bore in the part 29. The bore is either pre-threaded, or self-threaded by being screwed onto the bolt 27. This embodiment of the invention is designed for installation on a two-panel door or partition 30 viewable from its end.

Figure 1:
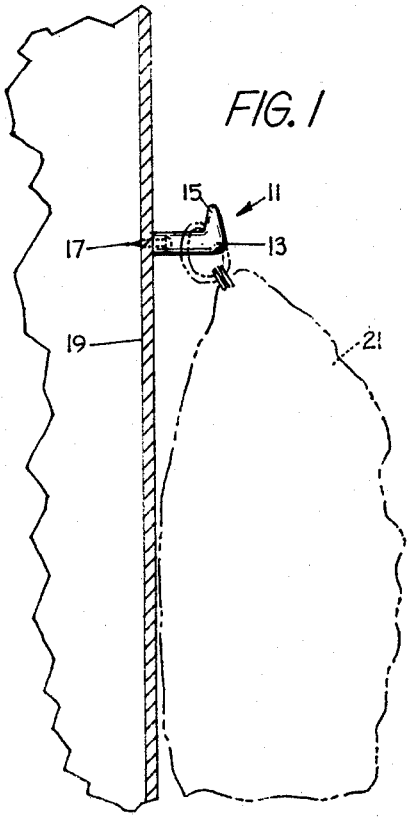
FIG. 1 is a side elevational view partly in section, showing a simple embodiment of the invention.
Figure 2:
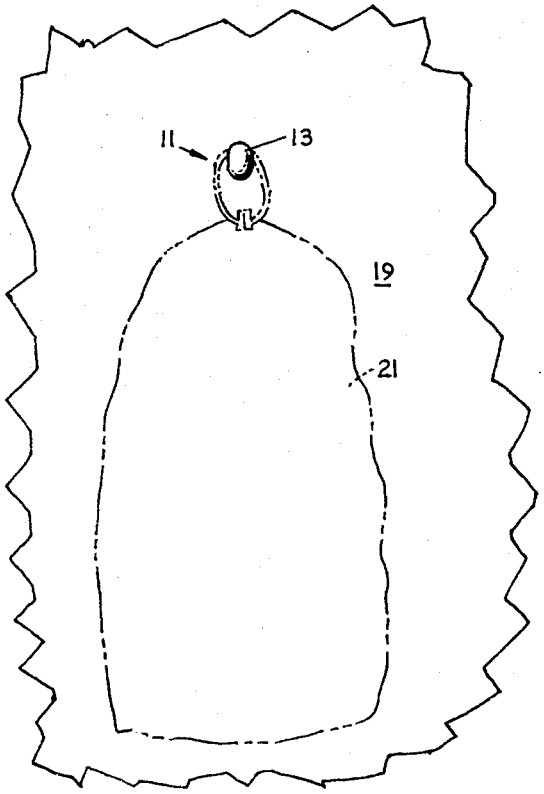
FIG. 2 is a front view of the disclosure of FIG. 1.
Figure 3:
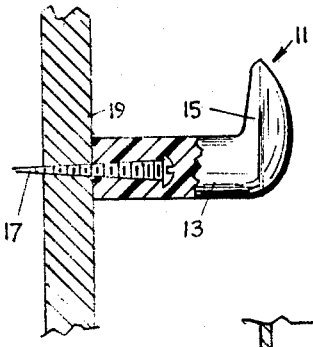
FIG. 3 is an enlarged fragmentary side view showing the support of FIG. 1 in more detail.
Figure 4:
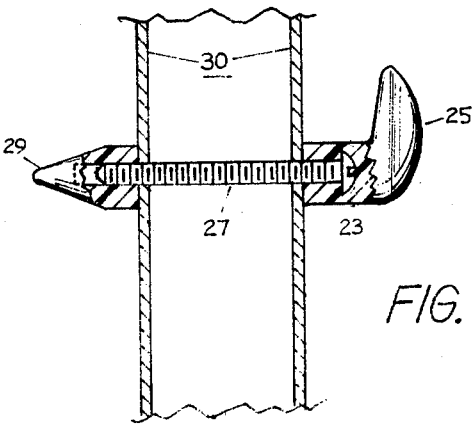
FIG. 4 is a side elevational view, partly in axial section, of a second species of the invention.
Figure 5:
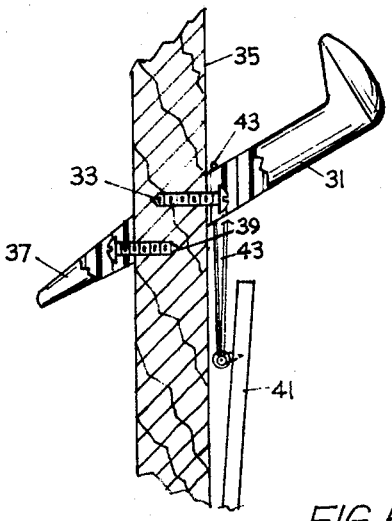
FIG. 5 is a side elevational view of a third species, partly in medial section.

The species of FIG. 5 is also designed for use with a door, or with a partition viewable from its end. The body 31 has a biased wall-engaging end from which the head-embedded screw 33 extends perpendicularly so that the simulated spike appears to have been driven into the wall 35 angled downwardly. A smaller body 37, simulating the pointed end of the spike, likewise has a biased wall-engaging end from which a head-embedded screw 39 protrudes perpendicularly. The assembled parts 31 and 37 create the illusion that a spike has been angularly driven through a door or partition. Part 41 is a picture frame, hung by a cord 43, to illustrate one typical use of the device.

The invention having been described, what is claimed is:

1. A combined article-hanger and illusion-amusement device, comprising: a body member simulating in size, shape and appearance the beveledly truncated head-end portion of a railroad-rail-anchoring spike, a relatively small rod-like screw element fixed to and extending perpendicularly from the opposite-the-head end of said body member for relatively non-defacing perpendicular penetration of a wall-like structure for slantingly fixing said body-member to said structure, a second body member simulating the beveledly truncated point end of a railroad-rail-anchoring spike, and a second small rod-like screw element extending from the opposite-the-point end of said second body member for slantingly fixing said second body member in alignment with said first-mentioned body member and on the opposite side of a door, partition or similar structure.

2. A device according to claim 1, said body-member being molded around and embedding a portion of said rod-like screw element.

3. A device according to claim 2, said rod-like screw element having an enlarged head on its embedded end.

4. A device according to claim 1, the contiguous ends of said body members having flat transverse surfaces angled relatively to said small rod-like elements so as to create the illusion that the simulated spike has been driven angled downwardly through a supporting upright structure.

* * * * *